US005747920A

United States Patent [19]

Devir et al.

[11] Patent Number: 5,747,920

[45] Date of Patent: May 5, 1998

[54] LAMP CAPSULE WITH ROTARY SWAGED LUG CONNECTORS

[75] Inventors: Daniel D. Devir, South Sutton; Charles M. Coushaine, Ringe, both of N.H.

[73] Assignee: Osram Sylvania Inc., Danvers, Mass.

[21] Appl. No.: 720,256

[22] Filed: Sep. 26, 1996

[51] Int. Cl.[6] ..... H01J 5/58

[52] U.S. Cl. ..... 313/318.09; 313/332; 313/318.05; 439/617

[58] Field of Search ..... 313/318.05, 318.01, 313/318.1, 318.09, 332, 331; 439/616, 617, 618, 679

[56] References Cited

U.S. PATENT DOCUMENTS

| | | | |
|---|---|---|---|
| 2,841,737 | 7/1958 | Klöpping et al. | 313/318.05 |
| 4,864,184 | 9/1989 | Fleming | 313/318.05 |
| 5,088,011 | 2/1992 | Williams et al. | 313/318.05 |
| 5,160,281 | 11/1992 | Culver et al. | 439/692 |
| 5,185,555 | 2/1993 | Lee | 313/332 |

*Primary Examiner*—Michael Horabik
*Assistant Examiner*—Michael Day
*Attorney, Agent, or Firm*—William E. Meyer

[57] ABSTRACT

A lamp capsule with lug connectors, having a lamp bulb, a holder, and a lug is disclosed. The lamp capsule lead extends through the holder passage to fit closely with the lug foot. The lug foot is then rotary swaged to the lamp lead. The swaging mechanically and electrically seals the lead and the lug. An interference coupling is exactly formed along the lead by the swaging, so the lead and lug are precisely located and cannot move with reference to one another. The lug and lead are then tightly held and located with reference to the holder. The mechanical interference fit also forms an electrical connection that cannot separate like a cold weld. The swaging may additionally remove any excess exterior extension of the lead. As a result, the lug is quickly, accurately, and permanently coupled to the lamp lead, and holder preventing subsequent loosening or displacement that may effect lamp positioning or connection durability.

4 Claims, 3 Drawing Sheets

LAMP CAPSULE WITH ROTARY SWAGED LUG CONNECTORS

1. TECHNICAL FIELD

The invention relates to electric lamps and particularly to electric lamps held by a holder. More particularly the invention is concerned with a rotary swaged connection between the lamp lead and the lug connector in a vehicle lamp capsule.

2. BACKGROUND ART

Headlamp bulbs may be held with metal clamps supported by plastic holders. The electric leads are then joined to metal lugs held in the plastic holder, so a socket like connector can be attached. Vehicle headlamp capsules are now frequently connected in this fashion. When the socket is pushed onto the lugs, the forces on the lugs may move the lug, stress the lug to lead connection, or transmit motion to the lamp if not securely anchored. Lug to lead couplings then must avoid such stress conduction. The lug to lead connection is also subject to thermal cycling, and possible corrosion. Failure of the lug to lead connection is an important problem to avoid, typically achieved by resistance or laser welding the lead and lug once they have been properly located with respect to each other.

Lead and lug welds require a locator to find the lead and lug junction, hold the two pieces in contact, and apply a quality laser or electrical weld without injuring the nearby structures. If the lead has an extended tail, it may interfere with the welding process, or if a successful weld is made, the tail may interfere with the subsequent socket connection. Unfortunately, laser welding has limited power and its effectiveness is sensitive to the masses of the materials being welded, and generally is unable to remove a lead tail. As a result the lead must then be trimmed beforehand to terminate close to the lug surface before welding. Accurate trimming is then a required aspect of a laser welded coupling, although accurate trimming consumes time, labor and energy. Resistance welding also requires the parts to be pressed together, while they are heated. If there is mechanical play in the assembly, the lamp may shift. If the lead and lug are pressed too tightly during welding, the lug and lead may be over stressed on cooling, or there may be a failure in the weld. The lug may melt into the holder, providing a small gap in the lug support and positioning. The lug can then be too loose, or too tight. The weld may or may not take. The lamp may be positioned correctly or not. There is then a need for a lamp capsule with lug connectors wherein the electrical coupling is made regardless of lead length, is done rapidly, securely, and with little possibility of movement of the parts. At the same time there is a need to mass produce such lamp capsules in the least amount of assembly time.

DISCLOSURE OF THE INVENTION

A lamp capsule with lug connectors may be formed from a lamp bulb having at least one extending lead, a holder having an internal wall with a passage formed in the wall, with the lead positioned to extend through the passage; and a lug with a foot portion positioned adjacent the internal wall, and having a hole formed in the foot, and aligned with respect to the wall passage, with the lead positioned to extend through the foot hole, and with a rotary swage formed in the lug, around the lead, thereby mechanically locking and electrically coupling the lead to the lug.

BEST MODE FOR CARRYING OUT THE INVENTION

Figure 1:
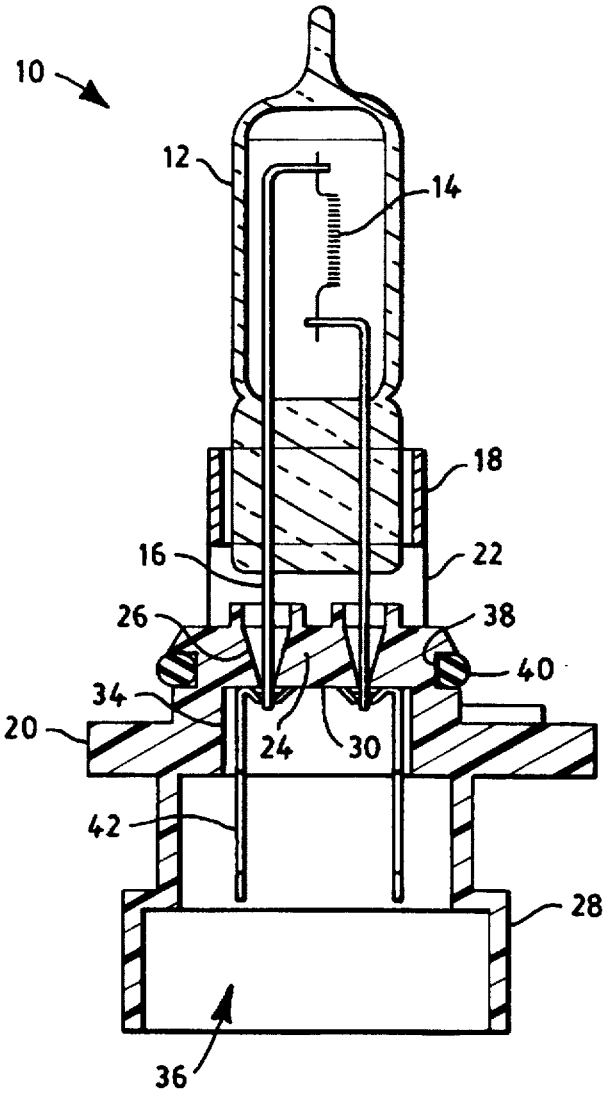
FIG. 1 shows a cross sectional view of a preferred embodiment of a lamp capsule with rotary swaged lug connectors.

FIG. 1 shows a preferred embodiment of a lamp capsule with rotary swaged lug connectors. Like reference numbers designate like or corresponding parts throughout the drawings and specification. The lamp capsule with rotary swaged lug connectors is assembled from a lamp bulb 10, a holder 20, and one or more lug 42.

The lamp bulb 10 has a envelope 12, a light source 14, one or more leads 16. The preferred envelope 12 is a quartz or hard glass, and the preferred light source 14 is a tungsten filament, although an arc lamp design could be accommodated. Extending from the lamp bulb 10 is a lead 16. Since, the rotational swaging force is not applied to the lead 16, but only to the lug 42, the lead 16 may be either stiff or flexible. Twisting of the lead 16 does not occur and is not considered a problem. The preferred lead 16 is a molybdenum rod.

The lamp bulb 10 may be held in a metal clamp 18 supported in a holder 20 that may be made out of plastic, for example a high temperature plastic or filled plastic. The plastic holder 20 may have any of numerous forms. Generally the holder 20 roughly has a cylindrical portion on an interior side 22 with a metal clamp 18 to support the lamp bulb 10. In a middle region of the holder 20 is an internal wall 24 to prevent the flow of air, water or contaminants to the lamp bulb 10 side of the holder 20. The internal wall 24 is formed with one or more lead passages 26 to conduct the lamp bulb leads 16 from the interior side 22 to an exterior side 28. The preferred lead passage 26 includes a cone shaped end facing the interior side 22, a narrow central region providing a snug, conformal fit to the lamp lead 16, and at a surface region 30 adjacent the exterior side 28 of the lead passage 26 to form a tight conformal fit to a lug 42. The preferred exterior surface 30 includes a planar resting surface, and a surrounding glue well 34. A preferred embodiment of the holder 20 is additionally described in U.S. Pat. No. 5,088,011 hereby incorporated by reference.

On the exterior side 28, the bulb leads 16 emerge to an exterior plug well 36. The holder 20 may further include sealing and latching mechanisms to lock the holder 20 in place relative to the lamp reflector. These may be conveniently chosen by a designer. The preferred holder 20 includes an O-ring groove 38 and O-ring 40 for sealing, and keyed radial arms for bayonet latching to a lamp reflector or lamp housing.

Figure 2:
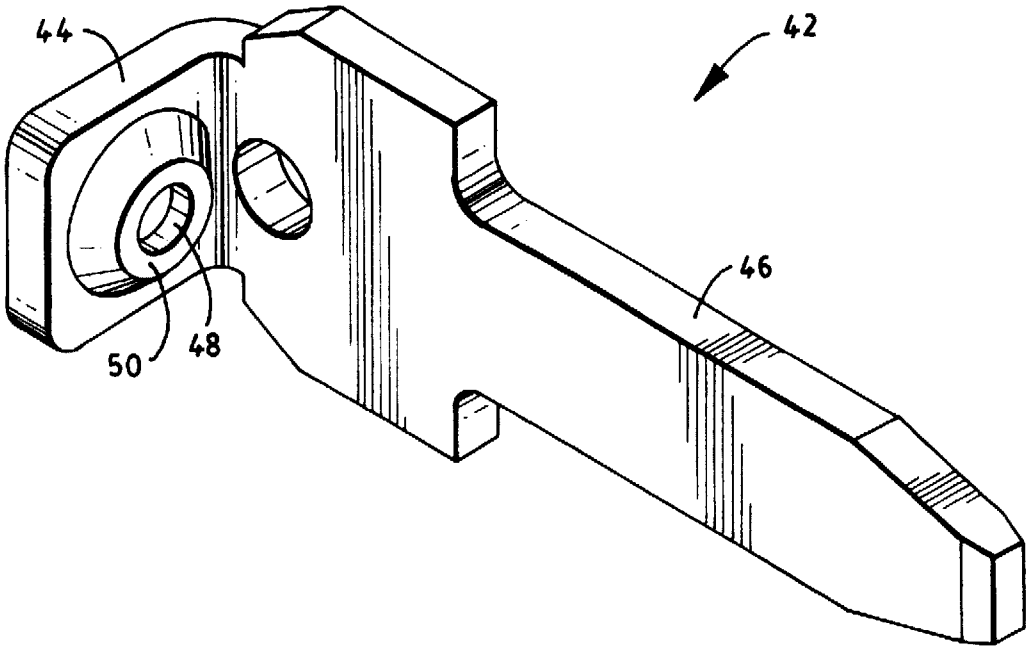
FIG. 2 shows a lug prior to assembly.

FIG. 2 shows a lug 42. The lug 42 may be made out of a stiff conductive material, such as a flat, narrow metal bar bent to have the general form of an L shape with a foot portion 44 and a back portion 46. The foot portion 44 is formed with a lug hole 48 sized to snugly receive an extended end of lead 16. In the preferred embodiment, in the lug foot 44, around the hole 48 is formed a swage lip 50 that generally faces the exterior side. The swage lip 50 may be the result of letting the foot 44 be deformed during the hole 48 formation, or by peening or otherwise bending the edge of the hole 48 up and away from the center of hole 48.

The lamp is assembled by staking or molding the lugs 42 in the glue wells 34. The holder 20 passage and the lug hole 48 are then aligned. The lamp bulb 10 is then inserted into the holder 20, threading the leads 16 through the conic openings, to extend through the internal wall 24 passage and the lug holes 48. The lamp bulb 10 is then properly aligned and locked in place by the chosen coupling method. The preferred swage tool is a shaft open at one end to an axial extending cavity sized to fit over the lead 16. The end of the shaft is beveled from both the outside edge, and from the inside edge to form circular V. The rotary swage tool is then advanced into the plug well 36 to fit over and surround the exterior extending end of lead 16. The swage tool is then further advanced to butt the V edge against lug foot 44 and swage lip 50. The swage tool is then rotated and further pressed against swage lip 50. The advancing swage tool then bears into the swage lip 50, deforming swage lip 50 in a ring surrounding lead 16. With further deformation, swage lip 50 is deformed to form a surrounding contact with lead 16. With still further deformation, lead 16 may be somewhat deformed by swage lip 50 continuing to be pressed into lead 16. Lead 16 and swage lip 50 are then pressed into intimate contact sealing, mechanically locking and electrically coupling lead 16 to lug 42. The forces of deformation are then substantially perpendicular to the lead 16, so little or no force is transmitted along the lead 16 to displace the lamp bulb 10, or to over or under press the lug 42 to the holder 20. The swage tool is then removed, and the remaining lead and lug pairs are sealed according to design. The lug well 34 may then be filled with a sealant as is known in the art.

Figure 3:
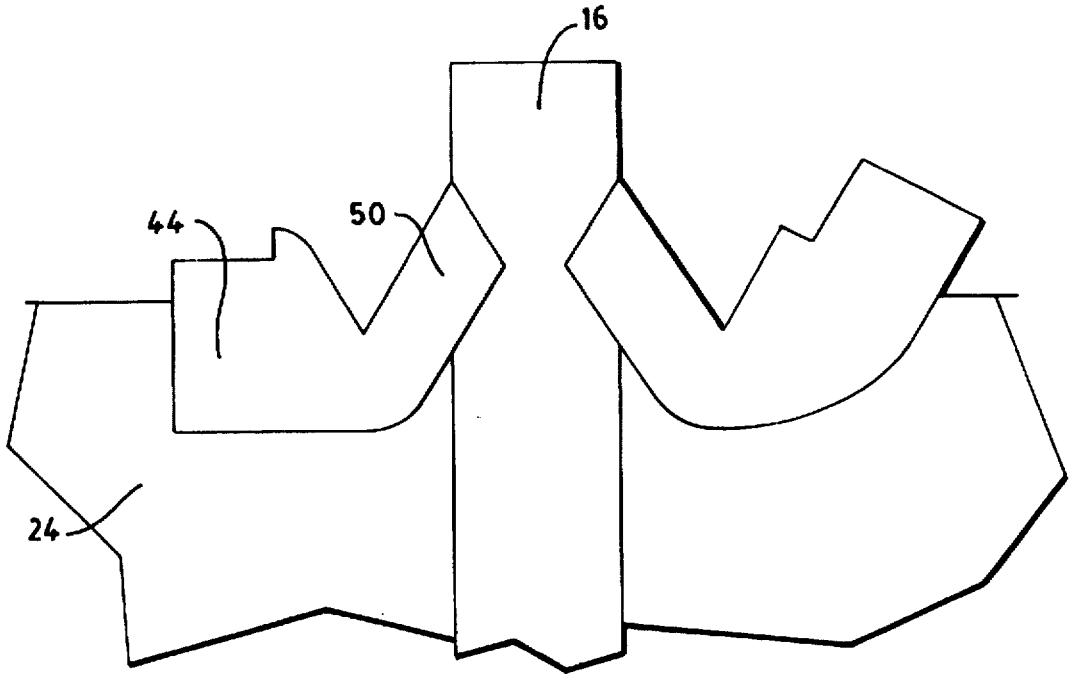
FIG. 3 shows a schematic drawing made from a photograph of an actual cross section of a rotary swaged coupling.

FIG. 3 shows a drawing made from a photograph of an actual cross section of the rotary swaged coupling. The lug 42 is firmly fixed in the holder 20. The swage lip 50 of the lug 42 has been rotary swaged thereby pressing the lug material into the side of lead 16. The swage lip 50 protrudes towards the lead 16 having the form of a widely spread V, while the adjacent lead 16 has a conformal indented V shaped trough intimately joined to the lug 42. The coupling extends in a circle around lead 16. Thereby locking lead 16 and lug 42 together, as sealing the interface between lead 16 and lug 42.

In one preferred embodiment, the connector was stamped from 0.60 millimeters (0.024 inch) thick tin plated brass. The connector lug had an L shape with a back section 15.47 millimeter (0.61 inch) long. The foot section was 3.28 millimeter (0.13 inch) long. A hole was formed in the foot with a diameter of 1.1 millimeter (0.04 inch). A swage lip was formed around the hole making a total with a height of 1.33 millimeter (0.05 inch) and an outer diameter of 1.82 millimeter (0.07 inch). The swaged tool had inner diameter of 1.04 millimeter (0.041 inch) and outer diameter of 3.175 millimeter (0.125 inch), and a circular V edge end with a diameter of 1.80 millimeter (0.071 inch). The cylindrical interior extended for 12.7 millimeter (0.5 inch) up the shaft. The disclosed operating conditions, dimensions, configurations and embodiments are as examples only, and other suitable configurations and relations may be used to implement the invention.

What is claimed is:

1. A lamp capsule with lug connectors comprising:

a) a lamp bulb having at least one extending lead, b) a holder having an internal wall with a passage formed in the wall, with the lead positioned to extend through the passage; and a c) a lug with a foot portion positioned adjacent the internal wall, and having a hole formed in the foot, and aligned with respect to the wall passage, with the lead positioned to extend through the foot hole, and with a rotary swage formed in the lug, around the lead, so that a portion of the lug is pressed into intimate contact with the lead thereby mechanically locking and electrically coupling the lead to the lug.

2. The apparatus in claim 1, wherein the lead is a round wire rod.

3. The apparatus in claim 1, wherein the lug has an L shape with a foot portion extending substantially flat against the holder, with the hole in the holder aligned with the hole in the lug, the coupler end extending substantially perpendicular to the foot portion.

4. A lamp capsule with at least one lug connector comprising:

a) a lamp bulb having a envelope, a light source enclosed in the envelope, and at least one lead extending from the envelope having a lead diameter, b) a holder, to support the lamp bulb, having a body with a passage formed therethrough with a holder hole diameter sufficient to allow the lead to pass through; and c) a lug, electrically connected to the lamp lead by the lamp bulb having a plate with a formed hole therethrough with a diameter sufficient to allow insertion of the lead, and a connector end, the lamp lead extending through the passage formed in the holder, and the hole formed in the plate, and being rotary swaged to the plate so that a portion of the plate is pressed into intimate contact with the lead to electrically and mechanically connect the lamp lead to the lug.

* * * * *